US010774457B2

(12) United States Patent
Kawakami et al.

(10) Patent No.: US 10,774,457 B2
(45) Date of Patent: Sep. 15, 2020

(54) WASHING MACHINE

(71) Applicants: QINGDAO HAIER WASHING MACHINE CO., LTD., Qingdao, Shandong (CN); AQUA CO., LTD., Tokyo (JP)

(72) Inventors: Takeshi Kawakami, Tokyo (JP); Satoshi Hatta, Tokyo (JP); Taro Otsuki, Tokyo (JP)

(73) Assignees: QINGDAO HAIER WASHING MACHINE CO., LTD., Qingdao, Shandong (CN); AQUA CO., LTD., Tokyo (JP)

( * ) Notice: Subject to any disclaimer, the term of this patent is extended or adjusted under 35 U.S.C. 154(b) by 207 days.

(21) Appl. No.: 15/768,509

(22) PCT Filed: Oct. 17, 2016

(86) PCT No.: PCT/CN2016/102271
§ 371 (c)(1),
(2) Date: Apr. 13, 2018

(87) PCT Pub. No.: WO2017/063601
PCT Pub. Date: Apr. 20, 2017

(65) Prior Publication Data

US 2018/0258574 A1 Sep. 13, 2018

(30) Foreign Application Priority Data

Oct. 16, 2015 (JP) ..... 2015-204223

(51) Int. Cl.
*D06F 37/26* (2006.01)
*D06F 37/20* (2006.01)
(Continued)

(52) U.S. Cl.
CPC ..... *D06F 37/268* (2013.01); *D06F 25/00* (2013.01); *D06F 29/005* (2013.01); *D06F 37/20* (2013.01); *D06F 37/26* (2013.01); *D06F 39/12* (2013.01)

(58) Field of Classification Search
CPC ..... D06F 37/268; D06F 37/20; D06F 37/26; D06F 39/12; D06F 25/00; D06F 29/005
See application file for complete search history.

(56) References Cited

U.S. PATENT DOCUMENTS 8,281,623 B2 * 10/2012 Lim ..... D06F 37/22 68/142
2009/0139273 A1 6/2009 Kim et al.
(Continued)

FOREIGN PATENT DOCUMENTS

CN 104321481 1/2015
CN 104321481 A 1/2015
(Continued)

OTHER PUBLICATIONS

International Application No. PCT/CN2016/102271, International Search Report, dated Feb. 3, 2016.
(Continued)

*Primary Examiner* — Benjamin L Osterhout
(74) *Attorney, Agent, or Firm* — Greenberg Traurig

(57) ABSTRACT

A fully automatic washing machine includes: a washing tub configured to enter into or exit from an outer casing through an entrance on a front surface; a holding plate disposed below the washing tub, and configured to support the washing tub via a hanger bracket; a door portion fixed to the holding plate in front of the washing tub, and configured to block the entrance; a sliding guiding rail disposed between the holding plate and the outer casing to linearly move the holding plate together with the washing tub and the door portion in a front-rear direction; and a connecter for con-
(Continued)

necting the hanger bracket with the holding plate. The connecter includes a vibration isolating device configured to prevent vibrations of the washing tub in the front-rear direction from being transferred to the holding plate via the hanger bracket.

4 Claims, 7 Drawing Sheets

(51) Int. Cl.

| | |
|---|---|
| ***D06F 25/00*** | (2006.01) |
| ***D06F 39/12*** | (2006.01) |
| ***D06F 29/00*** | (2006.01) |

(56) References Cited

U.S. PATENT DOCUMENTS

| | | | | |
|---|---|---|---|---|
| 2014/0053612 | A1 | 2/2014 | Son et al. | |
| 2014/0196507 | A1 | 7/2014 | Lee et al. | |
| 2016/0032515 | A1* | 2/2016 | Lee | D06F 13/00 68/27 |

FOREIGN PATENT DOCUMENTS

| | | | |
|---|---|---|---|
| CN | 104884698 | | 9/2015 |
| CN | 104884698 | A | 9/2015 |
| DE | 102008009791 | | 8/2009 |
| JP | 2002119786 | | 4/2002 |
| JP | 2007229219 | | 9/2007 |
| KR | 20080106822 | A | 12/2008 |
| KR | 20090057792 | | 6/2009 |
| KR | 101430464 | B1 | 8/2014 |
| KR | 101505629 | B1 | 3/2015 |

OTHER PUBLICATIONS

Extended European Search Report for Application No. 16854976.4 dated Apr. 18, 2019, 8 pages.

* cited by examiner

WASHING MACHINE

The present application is a national phase application under 35 U.S.C. § 371 of International Patent Application PCT/CN2016/102271, filed on Oct. 17, 2016, which claims priority to Japanese Patent Application No. 2015-204223, filed on Oct. 16, 2015, the entire disclosures of which applications are hereby incorporated herein by reference.

TECHNICAL FIELD

The present disclosure relates to a washing machine.

BACKGROUND

In the past, a drawer type washing machine, in which a cabinet with an open top is accommodated in a housing opened toward the front side so that the cabinet can be pulled out from the front side and a washing tub capable of storing washing water and used for carrying out washing and dewatering is provided in the cabinet, is proposed (see Patent Document 1). The washing tub is supported on a bottom surface of the cabinet via a hanger bracket having a buffer function. Furthermore, the cabinet can linearly move back and forth by means of a sliding portion provided between the cabinet and the housing.

In such a drawer type washing machine, the resistance inside the sliding portion, that is, the resistance between a roller and a guiding rail in the configuration of Patent Document 1, is reduced as much as possible so as to easily pull the cabinet out of the housing. However, in the case that the cabinet can easily move back and forth with respect to the housing, the cabinet tends to vibrate violently in the front-rear direction if vibration of the washing tub generated during dewatering is not completely absorbed by the hanger bracket and is transferred to the cabinet.

Generally, a latch is mounted between a front surface of the closed cabinet, namely a door portion, and a front surface of the housing to lock the door portion. However, a certain end play is provided in the latch. Therefore, when the cabinet violently vibrates in the front-rear direction, a minute collision occurs repeatedly between the door portion and the front surface of the housing, thereby generating noises or damaging the door portion.

RELATED LITERATURE

Patent Literature

Patent Literature 1: Japanese Laid-Open Patent Publication No. 2002-119786

SUMMARY

Problem to be Solved by the Present Disclosure

The present disclosure is made in view of the above problems, and aims to suppress noises and damages to a door portion generated in a washing machine, in which a washing tub may be pulled out of an outer casing, due to a minute collision repeatedly occurred between the door portion and the outer casing.

Solution to the Technical Problem

The washing machine according to a main aspect of the present disclosure includes an outer casing, where an entrance is provided on a front surface of the outer casing; a washing tub in which washings are washed and dewatered, where the washing tub enters into or exits from the outer casing through the entrance; a holding portion disposed below the washing tub and configured to support the washing tub via a hanger bracket; a door portion fixed to the holding portion in front of the washing tub, and the entrance is blocked by door portion when the washing tub is accommodated in the outer casing; a sliding mechanism provided between the holding portion and the outer casing and configured to linearly move the holding portion together with the washing tub and the door portion in a front-rear direction, and a connecter for connecting the hanger bracket with the holding portion, and the connecter includes a vibration absorber configured to prevent vibrations of the washing tub in the front-rear direction from being transferred to the holding portion via the hanger bracket.

According to the above configuration, it is possible to suppress vibrations of the holding portion in the front-rear direction. Therefore, it is possible to suppress a minute collision occurred between the door portion and the outer casing due to the vibrations of the washing tub, and suppress occurrence of noises and the damages to the door portion.

In the washing machine according to this aspect, the vibration absorber includes: a moving path provided on the holding portion; and a movable member provided on the hanger bracket and moving on the moving path in the front-rear direction. In such a case, a frictional force generated when the movable member moves on the moving path is smaller than the frictional force generated when the holding portion is caused to move by the sliding mechanism.

By means of the above structure, since the movable member moves more easily in the front-rear direction than the holding portion, the vibrations of the holding portion in the front-rear direction can be effectively inhibited by the vibration absorber.

In the above configuration, the movable member is configured to be guided by the moving path and does not move in the left-right direction.

With such a configuration, the washing tub does not vibrate sharply in the left-right direction as compared with the front-rear direction, and the size of the outer casing in the left-right direction will not be too large.

In the washing machine according to this aspect, the door portion is configured to be fixed to the holding portion via a buffer member.

According to the above configuration, since vibrations of the holding portion are absorbed by the buffer member, vibrations are less likely to be transferred to the door portion, and a minute collision between the door portion and the outer casing is hardly to occur.

Effect of the Present Disclosure

The present disclosure can suppress noises and damages to a door portion generated in a washing machine, in which a washing tub may be pulled out of an outer casing, due to a minute collision repeatedly occurred between the door portion and the outer casing.

The effect or significance of the present disclosure will be further clarified by the description of embodiments described below. It is to be noted that the following embodiments are merely examples for implementing the present disclosure, and the present disclosure is not limited to the contents described in the following embodiments.

LIST OF REFERENCE NUMERALS

1: Fully automatic washing machine (washing machine); 10: Outer casing; 20: Washing tub; 60: Hanger bracket; 70: Connecter; 80: Holding plate (holding portion); 90: Door portion; 100: Sliding guiding rail (Sliding mechanism); 110: Buffer member; 500: Vibration isolating device (vibration absorber); 510: Slider (movable body); 520: Guiding rail (moving path); 530: Movable block (movable body); 540: Guiding rail (moving path)

DETAILED DESCRIPTION

Hereinafter, a fully automatic washing machine 1 according to an embodiment of the present disclosure will be described with reference to the drawings.

Figure 1:
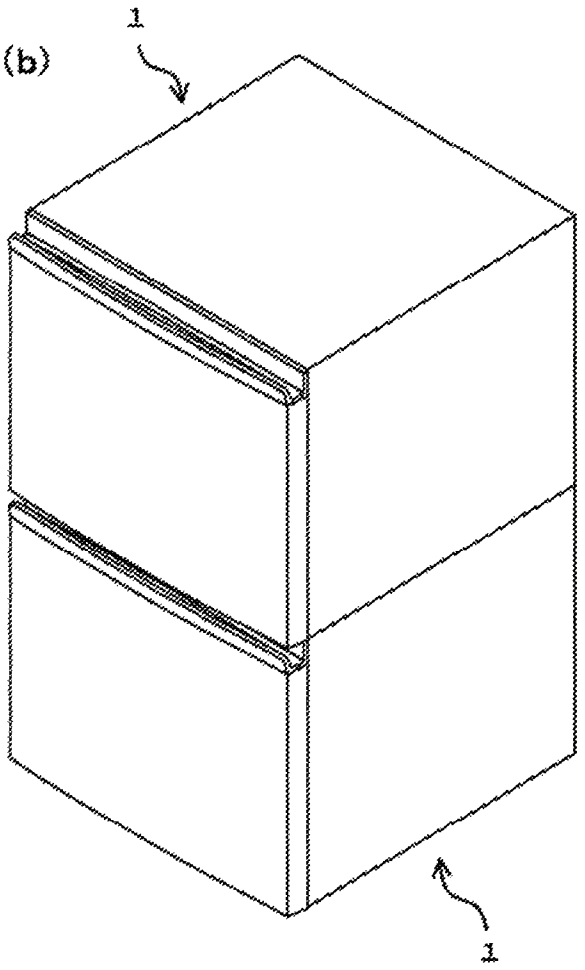
FIG. 1(*a*) is a perspective view as viewed from front illustrating a fully automatic washing machine according to an embodiment, and FIG. 1(*b*) is a perspective view as viewed from front illustrating two fully automatic washing machines stacked vertically according to an embodiment.
Figure 1:
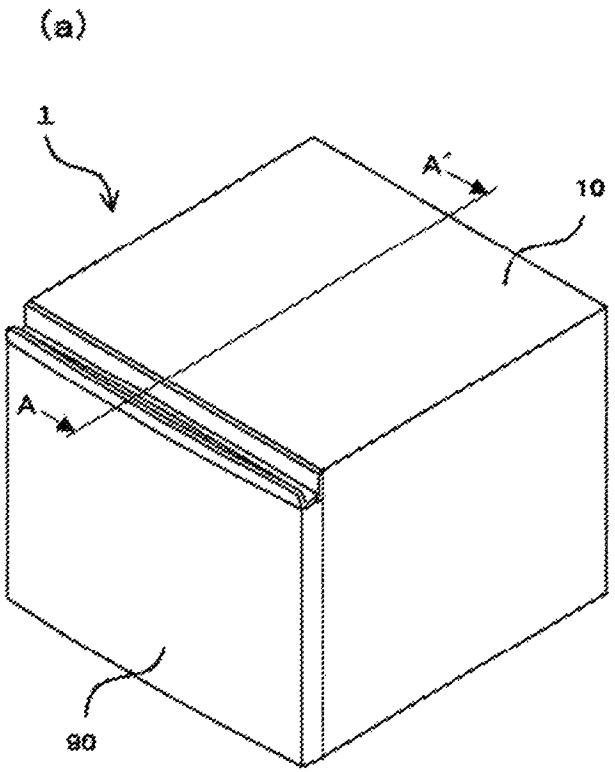
Figure 2:
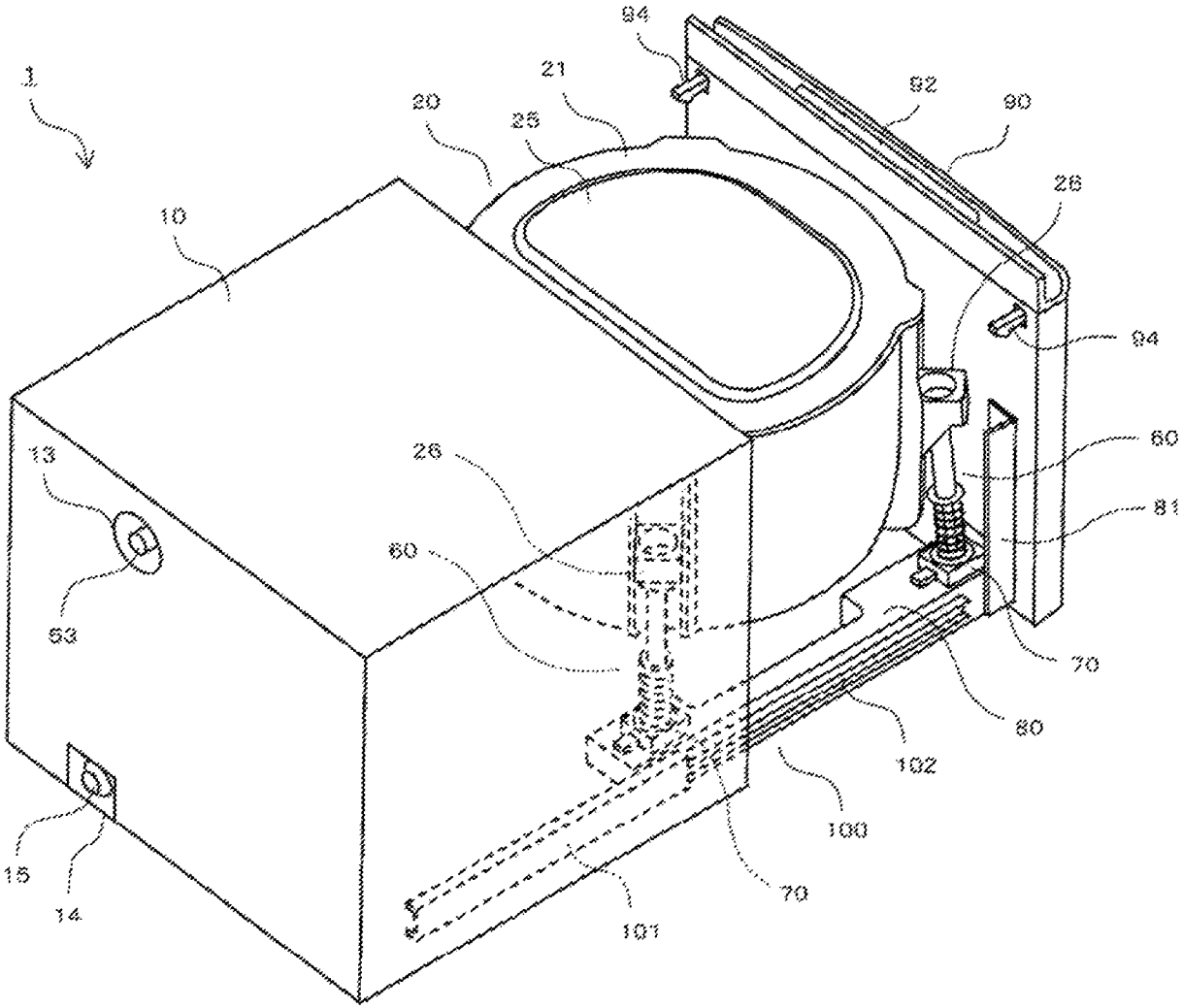
FIG. 2 is a perspective view as viewed from rear illustrating a fully automatic washing machine with a washing tub being pulled out toward the front of an outer casing according to an embodiment.
Figure 3:
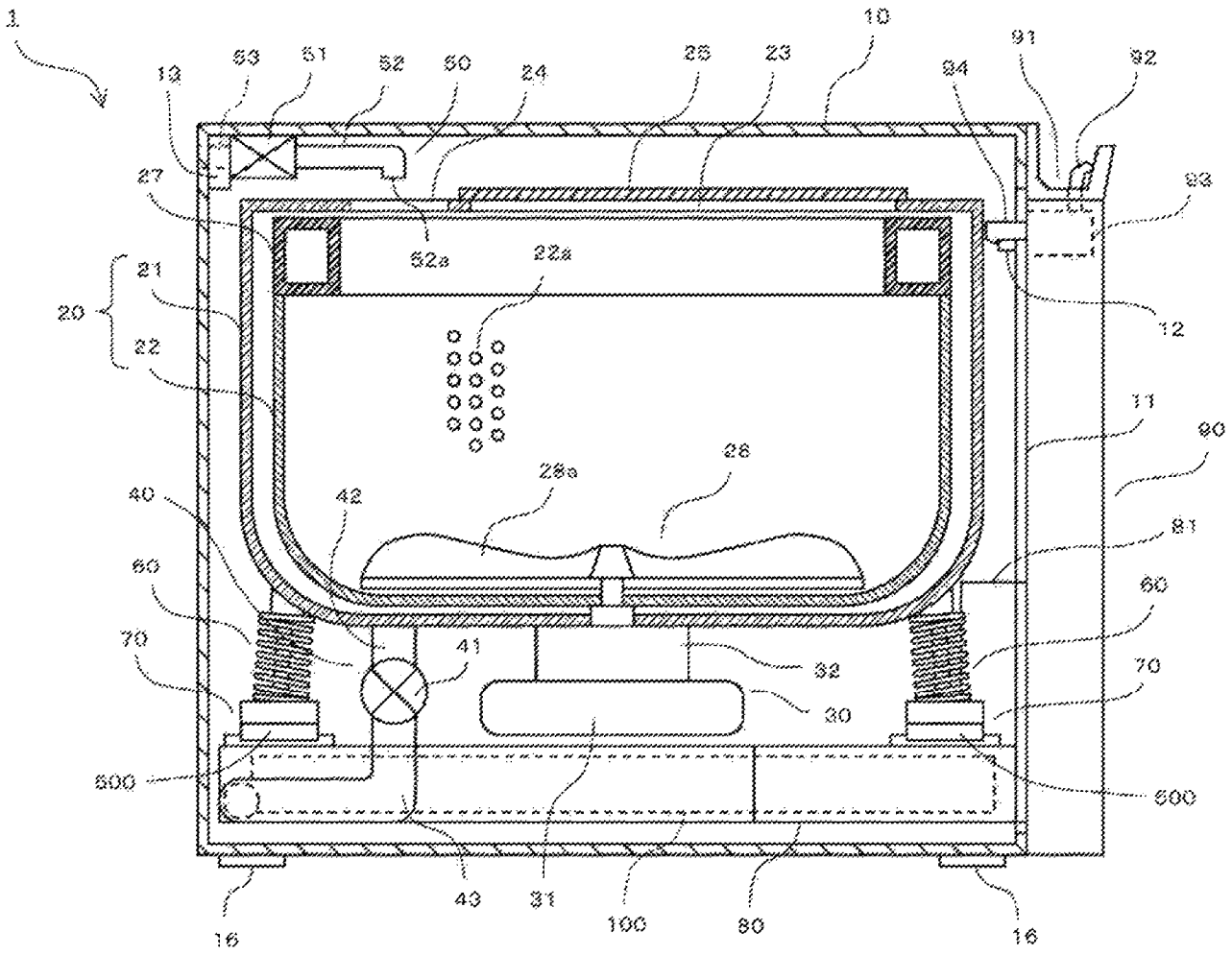
FIG. 3 is a side sectional view of a fully automatic washing machine, taken along line A-A' in FIG. 1(*a*), according to an embodiment.

FIG. 1(*a*) is a perspective view viewed from front illustrating a fully automatic washing machine 1, and FIG. 1(*b*) is a perspective view as viewed from front illustrating two fully automatic washing machines 1 stacked vertically. FIG. 2 is a perspective view as viewed from rear illustrating the fully automatic washing machine 1 with a washing tub 20 being pulled out toward the front of an outer casing 10. FIG. 3 is a side sectional view of the fully automatic washing machine 1 taken along line A-A' in FIG. 1(*a*).

Referring to FIGS. 1 to 3, the fully automatic washing machine 1 includes an outer casing 10, a washing tub 20, a driving unit 30, a drain unit 40, a water supply unit 50, four hanger brackets 60 (i.e., a left front hanger bracket, a right front hanger bracket, a left rear hanger bracket, a right rear hanger bracket), four connectors 70 (i.e., a left front connector, a right front connector, a left rear connector, a right rear connector), two holding plates 80 (i.e., a left holding plate and a right holding plate), a door portion 90, and a pair of sliding guiding rails 100 (i.e., a left sliding guiding rail and a right sliding guiding rail). The holding plates 80 correspond to a holding portion of the present disclosure, and the sliding guiding rails 100 correspond to a sliding mechanism of the present disclosure.

The fully automatic washing machine 1 is a so-called drawer type washing machine. A user pulls the washing tub 20 forward out of the outer casing 10, throws washings into the washing tub 20 being pulled out from above, and withdraws the washing tub 20 to the outer casing 10 to wash the washings. As shown in FIG. 1(*b*), since two fully automatic washing machines 1 can be installed on the floor of a washroom or the like by stacking one of them on the top of the other, the space can be effectively used so that the washings can be washed separately.

The outer casing 10 has a substantially rectangular parallelepiped shape, and nearly the entire front surface thereof is opened as an entrance 11. On left and right inner side surfaces of the outer casing 10, an engaging portion 12 is provided at the upper part in the vicinity of the entrance 11. On the rear surface of the outer casing 10, a water supply connection port 13 is formed at the upper portion, and a drain connection port 14 is formed at the lower portion. A drain joint 15 is provided at the drain connection port 14. Further, on the bottom surface of the outer casing 10, a leg 16 is provided at each of four corners.

The washing tub 20 includes an outer tub 21 and a washing/dewatering tub 22. A loading port 23 is formed on the upper surface of the outer tub 21, and a water inlet 24 is formed at the rear of the loading port 23. The loading port 23 is covered with an openable and closable inner lid 25. Hanger bracket mounting portions 26 are provided on the outer peripheral surface of the outer tub 21 at a right/left end on the front side thereof and a right/left end on the rear side thereof, respectively. The hanger bracket mounting portions 26 may be either formed integrally with the outer tub 21 or formed separately from the outer tub 21 and fixed to the outer tub 21. It is noted that, in the outer casing 10, a gap between the washing tub 20 and the outer casing 10 is larger in the front-rear direction than that in the left-right direction.

The washing/dewatering tub 22 is disposed in the outer tub 21. The washing/dewatering tub 22 rotates about a rotation axis extending in the vertical direction in the outer tub 21. A plurality of dewatering holes 22*a* are formed throughout an entire inner peripheral surface of the washing/dewatering tub 22. A balance ring 27 is provided on the upper portion of the washing/dewatering tub 22. Further, a pulsator 28 is provided on the bottom of the washing/dewatering tub 22. A plurality of blades 28*a* are provided radially on the surface of the pulsator 28.

The driving unit 30 and the drain unit 40 are disposed on the outer bottom of the outer tub 21. The driving unit 30 is configured to generate torques for driving the washing/dewatering tub 22 and the pulsator 28. The driving unit 30 includes a driving motor 31 and a transmission mechanism 32. The transmission mechanism 32 includes a clutch mechanism. Through switching operations made by the clutch mechanism, the torque of the driving motor 31 is only transferred to the pulsator 28 to merely rotate the pulsator 28 during a washing process and a rinsing process, and the torque of the driving motor 31 is transferred to the pulsator 28 and the washing/dewatering tub 22 to integrally rotate the pulsator 28 and the washing/dewatering tub 22 during a dewatering process.

The drain unit 40 includes a drain valve 41, a drain pipe 42, and an internal drain hose 43. An end of the drain valve 41 is connected to the drain pipe 42, and the other end of the drain valve 41 is connected to the internal drain hose 43. The drain pipe 42 is connected to a drain port (not shown) formed at the bottom of the outer tub 21. The internal drain hose 43 is connected to the drain joint 15 of the drain connection port 14 from the inside of the washing machine. An external drain hose (not shown) is connected to the drain joint 15 from the outside of the washing machine. When the drain valve 41 is opened, water stored in the washing/dewatering tub 22 and the outer tub 21 is discharged to the outside of the machine through the drain pipe 42, the internal drain hose 43, and the external drain hose.

When the washing tub 20 is accommodated in the outer casing 10, the internal drain hose 43 is configured to meander left and right and fit in the rear portion of the outer casing 10. When the washing tub 20 is pulled out of the outer casing 10, the inner drain hose 43 is pulled by the washing tub 20 and deforms from a meandering state to a straight state.

The water supply unit 50 is provided at the upper rear part in the outer casing 10. The water supply unit 50 includes a water supply valve 51, a water supply pipe 52, and a connection pipe 53. An end of the water supply valve 51 is connected to the water supply pipe 52, and the other end of the water supply valve 51 is connected to the connection pipe 53. When the washing tub 20 is accommodated in the outer casing 10, an outlet 52*a* of the water supply pipe 52 faces the water inlet 24 of the outer tub 21. The connecting pipe 53 faces the outside in the water supply connection port 13, and is connected to a water supply hose (not shown) extending from a water tap. When the water supply valve 51 is opened, the tap water is supplied into the outer tub 21 through the water supply pipe 52 and the water inlet 24.

The washing tub 20 is held on the left holding plate 80 and the right holding plate 80 below the washing tub 20 via the four hanger brackets 60 (i.e., a left front hanger bracket, a right front hanger bracket, a left rear hanger bracket, a right rear hanger bracket). An upper end of each of the hanger brackets 60 is fixed to one of the hanger bracket mounting portions 26 of the washing tub 20, and a lower end of each of the hanger brackets 60 is fixed to the holding plate 80 via one of the connecters 70. The hanger brackets 60 support the washing tub 20 in a buffer manner. Each of the holding plates 80 is elongated in the front-rear direction, the right holding plate 80 carries two hanger brackets 60 on the right side (i.e., the right front and right rear hanger brackets), and the lest holding plate 80 carries two hanger brackets 60 at the left side (i.e., the left front and left rear hanger brackets). By having the vibration isolating device 500, the connecter 70 is capable of preventing the vibrations of the washing tub 20 in the front-rear direction from being transferred to the holding plate 80 via the hanger bracket 60.

The detailed configuration of each of the hanger brackets 60 and the connecters 70 will be described later.

The door portion 90 is fixed to the front end of the left/right holding plate 80 by a L-shaped metal mounting member 81. A locking device 91 is provided on the upper portion of the door portion 90 for holding the door portion 90 in a closed state with respect to the outer casing 10.

The locking device 91 includes a lever 92, a link mechanism 93, and two latches 94 (i.e., a left latch and a right latch). As shown in FIG. 3, when the door portion 90 is closed, each of the latches 94 is engaged with an engaging portion 12 of the outer casing 10. When the door portion 90 is to move forward, each of the latches 94 catches on the engaging portion 12, and the door portion 90 is held in a closed state. When the user operates the lever 92 in a releasing direction, the latch 94 moves upward by the actions of the link mechanism 93, and the engagement between the latch 94 and the engaging portion 12 is released. As a result, the washing tub 20 and the door portion 90 are brought into a state where both of them can be pulled out of the outer casing 10. It is noted that a certain clearance is provided between the latch 94 and the engaging portion 12 as end play when the latch 94 is engaged with the engaging portion 12.

The left and right holding plates 80 linearly move in the front-rear direction together with the washing tub 20 and the door portion 90 by the left and right sliding rails 100, respectively. Each of the sliding rails 100 includes a fixed guiding rail 101 and a movable guiding rail 102 which are elongated in the front-rear direction. The fixed guiding rail 101 is fixed to the lower part of the inner side surface of the outer casing 10, and the movable rail 102 is fixed to a surface of the holding plate 80, which is opposed to the inner side surface of the outer casing 10. A roller (not shown) is provided inside the fixed guiding rail 101, and the movable rail 102 is transmitted by the roller so as to move in the front-rear direction within the fixed guiding rail 101. As a result, the holding plate 80 fixed to the movable rail 102 smoothly moves in the front-rear direction together with the washing tub 20 and the door portion 90.

The fully automatic washing machine 1 performs a washing operation of various operation modes. During the washing operation, a washing process, an intermediate dewatering process, a rinsing process and a final dewatering process are sequentially executed.

In the washing process and the rinsing process, the pulsator 28 rotates rightward and leftward while water is stored in the washing/dewatering tub 22. A water flow is generated in the washing/dewatering tub 22 by the rotation of the pulsator 28. In the washing process, the washings are washed by the water flow generated and detergent contained in the water. In the rinsing process, the washings are rinsed by the water flow generated.

In the intermediate dewatering process and the final dewatering process, the washing/dewatering tub 22 and the pulsator 28 rotate integrally at a high speed. The washings are dewatered by the centrifugal force generated in the washing/dewatering tub 22.

Next, detailed configurations of the hanger bracket 60 and the connecter 70 will be described.

Figure 4:
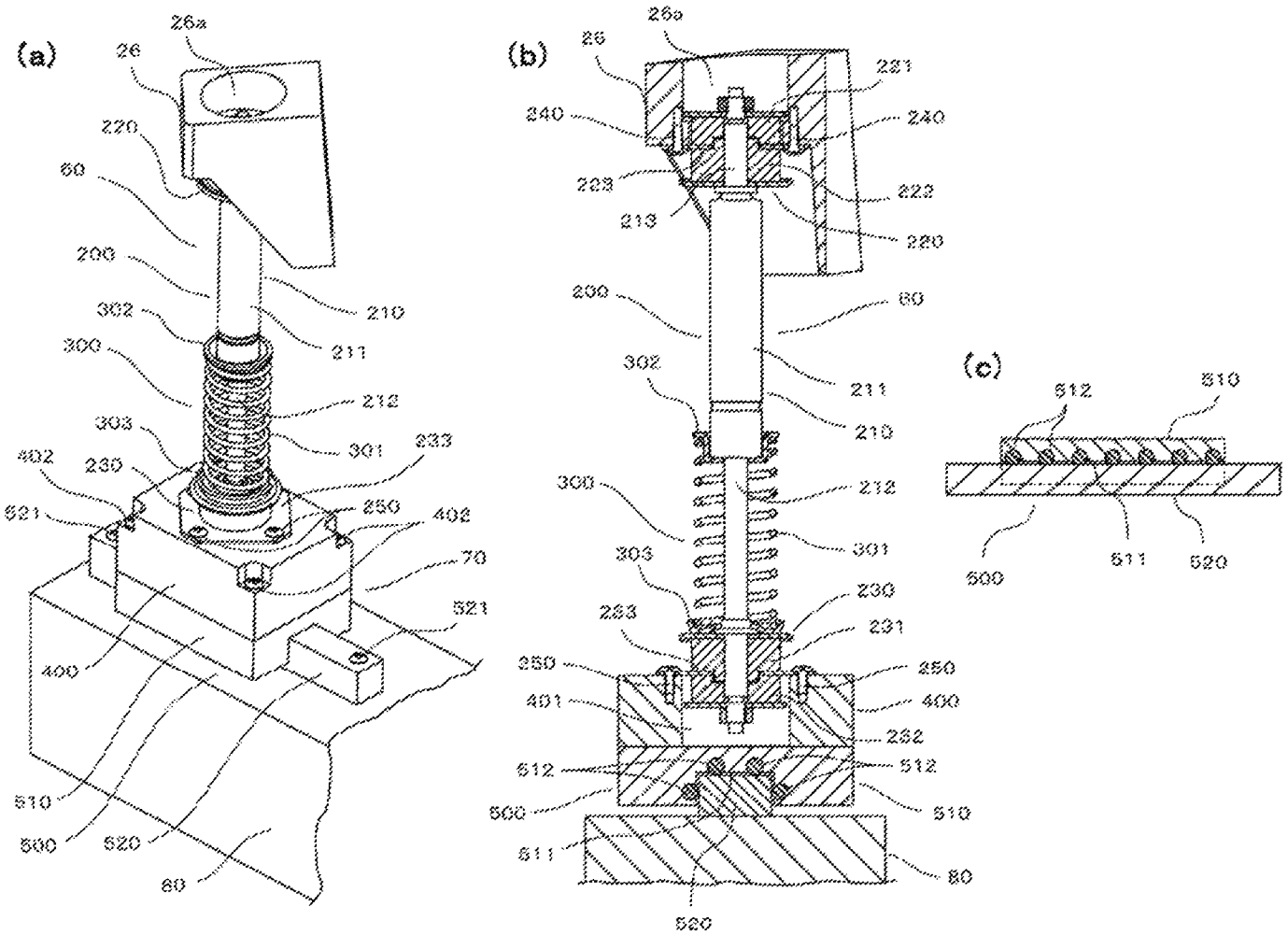
FIGS. 4(*a*) to 4(*c*) illustrate configurations of a hanger bracket and a connecter according to an embodiment.

FIGS. 4(*a*) to 4(*c*) illustrate configurations of the hanger bracket 60 and the connecter 70. FIG. 4(*a*) is a perspective view of the right front hanger bracket 60 and the right front connecter 70 as viewed from the rear, and FIG. 4(*b*) is a front sectional view of the hanger bracket 60 and the connecter 70 cut at the center in the front-rear direction. FIG. 4(*c*) is a side sectional view of the vibration isolating device 500 provided in the connecter 70. In FIGS. 4(*a*) and 4(*b*), the hanger bracket mounting portion 26 at the front right of the outer tub 21 is drawn, and the other portions of the outer tub 21 are not shown.

The hanger bracket 60 includes a damper portion 200 and a spring portion 300. The damper portion 200 includes a damper 210, an upper attachment portion 220, and a lower attachment portion 230.

The damper 210 includes a cylinder 211, a piston rod 212, and an upper rod 213. Oil is enclosed in the cylinder 211. The piston rod 212 has a piston (not shown) at its upper end. When the piston rod 212 moves up and down, the piston moves up and down in the cylinder 211 and slides on the inner peripheral surface of the cylinder 211. The upper rod 213 is provided integrally with the cylinder 211 at the upper end of the cylinder 211. Although the damper 210 is a hydraulic damper in which the oil is enclosed in the cylinder 211 in the present embodiment, the damper 210 may be an air damper in which the air is enclosed in the cylinder 211.

The upper attachment portion 220 includes a first upper buffer body 221, a second upper buffer body 222, and an upper attachment plate 223. The first upper buffer body 221 and the second upper buffer body 222 have a substantially cylindrical shape, and are formed of an elastic material such as rubber. The first upper buffer body 221 and the second upper buffer body 222 are fixed to the upper attachment plate 223 from above and below to sandwich the upper attachment plate 223 between the first upper buffer body 221 and the second upper buffer body 222. The upper rod 213 is fixed to the upper attachment plate 223 via the first upper buffer body 221 and the second upper buffer body 222.

The lower attachment portion 230 includes a first lower buffer body 231, a second lower buffer body 232, and a lower attachment plate 233. The first lower buffer body 231 and the second lower buffer body 232 have a substantially cylindrical shape, and are formed of an elastic material such as rubber. The first lower buffer body 231 and the second lower buffer body 232 are fixed to the lower attachment plate 233 from above and below to sandwich the lower attachment plate 233 between the first lower buffer body 231 and the second lower buffer body 232. The lower end of the piston rod 212 is fixed to the lower attachment plate 233 via the first lower buffer body 231 and the second lower buffer body 232.

The spring portion 300 includes a coil spring 301, an upper receiving portion 302, and a lower receiving portion 303. The upper receiving portion 302 is fixed to the lower end of the cylinder 211 to receive the upper end of the coil spring 301. The lower receiving portion 303 is fixed to the piston rod 212 at the upper end of the lower attachment portion 230 to receive the lower end of the coil spring 301.

The connecter 70 includes a mounting base 400 and the vibration isolating device 500. The mounting base 400 is formed in a substantially rectangular parallelepiped shape that is flat vertically, and has a cylindrical receiving hole 401 in the center thereof.

The vibration isolating device 500 includes a slider 510 and a guiding rail 520. The vibration isolating device 500 corresponds to a vibration absorber of the present disclosure, the slider 510 corresponds to a moving body of the present disclosure, and the guiding rail 520 corresponds to a moving path of the present disclosure.

The slider 510 is formed in a substantially rectangular parallelepiped shape that is flat vertically. The slider 510 has a groove 511, which has a rectangular cross section and extends in the front-rear direction, at the center of the lower surface of the slider 510. The mounting base 400 is fixed to the upper surface of the slider 510 by a screw 402. At four positions in the vicinity of the groove 511 in the slider 510, four balls 512 are rotatably arranged at a predetermined interval in the front-rear direction. A part of the balls 512 are exposed into the groove 511.

The guiding rail 520 has a substantially rectangular parallelepiped shape elongated in the front-rear direction. The dimension of the guiding rail 520 in the front-rear direction is longer than that of the slider 510. The guiding rail 520 is fixed to the upper surface of the holding plate 80 by a screw 521.

When the groove 511 of the slider 510 is fitted into the guiding rail 520, the four balls 512 abut against the left/right side surfaces and the upper surface of the guiding rail 520. As a result, when the slider 510 moves on the guiding rail 520 in the front-rear direction, the balls 512 in contact with the guiding rail 520 roll, so that frictional force between the slider 510 and the guiding rail 520 becomes small. It is noted that the frictional force between the slider 510 and the guiding rail 520 is set to be smaller than the frictional force generated between the movable guiding rail 102 and the fixed guiding rail 101 when the movable guiding rail 102 moves in the front-rear direction with respect to the fixed guiding rail 101. Further, since the guiding rail 520 is fitted into the groove 511, the slider 510 is guided in the front-rear direction by the guiding rail 520 and cannot move in the left-right direction.

The upper end of the hanger bracket 60 is fixed to the hanger bracket mounting portion 26 by fastening the upper attachment plate 223 to the lower surface of the hanger bracket attachment portion 26 via screws 240. A cylindrical receiving hole **26*a* is formed in the hanger bracket mounting portion 26, and the upper portion of the upper attachment portion 220 is accommodated in the receiving hole 26*a*. The lower end of the hanger bracket 60 is fixed to the connecter 70 by fastening the lower attachment plate 233 to the upper surface of the attachment base 400 via screws 250. At this time, the lower portion of the lower attachment portion 230 is accommodated in the receiving hole 401 of the mounting base 400**.

The hanger bracket 60 resiliently supports the washing tub 20 by the spring portion 300, and attenuates the vibration of the spring portion 300 by the damper portion 200. In the dewatering process, although the washing tub 20 vibrates in the front-rear direction, the left-right direction and the up-down direction due to the bias of the washings in the washing/dewatering tub 22, etc., such vibrations of the washing tub 20 are absorbed by the hanger bracket 60. However, vibrations cannot be absorbed completely by the hanger bracket 60, and some vibrations are transferred to the connecter 70 via the hanger bracket 60.

As described above, the vibration isolating device 500 is provided in the connecter 70, so that vibrations transferred to the connecter 70 in the front-rear direction are absorbed as the slider 510 moves in the front-rear direction on the guiding rail 520 due to the vibrations. As a result, the vibrations in the front-rear direction are prevented from being transferred to the holding plate 80. Here, the frictional force between the slider 510 and the guiding rail 520 is smaller than the frictional force between the movable guiding rail 102 and the fixed guiding rail 101 of the sliding guiding rail 100, thus the slider 510 moves more easily in the front-rear direction compared to the movable guiding rail 102. As a result, the vibrations that are absorbed by the vibration isolating device 500 and then transferred to the holding plate 80 become a force with which the movable guiding rail 102 cannot be moved. Therefore, no matter whether the holding plate 80 is attached to the sliding guiding rail 100, the holding plate 80 hardly vibrates in the front-rear direction as the washing tub 20 vibrates. In this way, in the fully automatic washing machine 1, the case where minute collisions occur repeatedly between the door portion 90 fixed to the holding plate 80 and the peripheral edge of the entrance 11 of the outer casing 10 due to the vibration of the washing tub 20 is avoided.

Effect of the Embodiment

As described above, according to the present embodiment, the vibration isolating device 500 provided in the connecter 70 prevents the vibration in the front-rear direction of the washing tub 20 from being transferred to the holding plate 80 through the hanger bracket 60. Therefore, vibrations of the holding plate 80, which easily moves by the sliding guiding rail 100, in the front-rear direction can be suppressed. This makes it possible to prevent repeated collisions between the door portion 90 and the outer casing 10 due to the vibration of the washing tub 20, and it is possible to suppress occurrences of noises and damages to the door portion 90.

Furthermore, according to the present embodiment, the vibration isolating device 500 includes the guiding rail 520 and the slider 510 that moves on the guiding rail 520 in the front-rear direction, and the frictional force between the slider 510 and the guiding rail 520 is smaller than the frictional force between the movable guiding rail 102 and the fixed guiding rail 101. Therefore, the slider 510 is more easily to move in the front-rear direction than the movable guiding rail 102, thereby effectively suppressing vibrations in the front-rear direction of the holding plate 80 by the vibration isolating device 500.

Furthermore, according to the present embodiment, the vibration isolating device 500 is configured such that the slider 510 is guided by the guiding rail 520 and does move in the left-right direction. Therefore, the washing tub 20 does not vibrates more dramatically in the left-right direction than in the front-rear direction, and the size of the outer casing 10 in the left-right direction will not be too large.

Although the embodiment of the present disclosure has been described above, the present disclosure is not limited by the above-described embodiment, and various modifications other than the above are also applicable to the embodiment of the present disclosure.

<Modification I>

Figure 5:
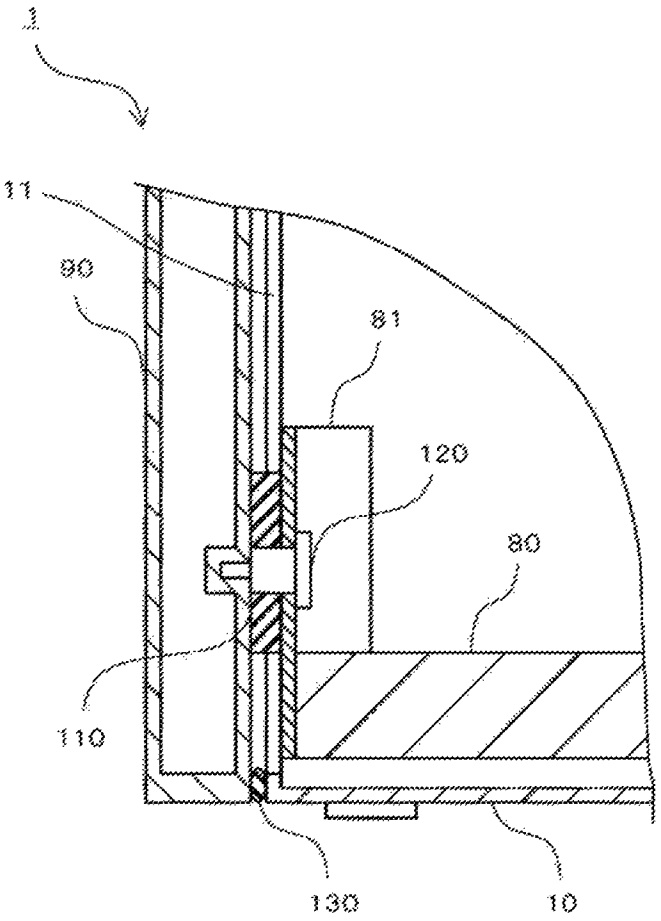
FIG. 5 is a sectional view illustrating main parts of the configuration of a fully automatic washing machine according to modification I.

FIG. 5 is a sectional view illustrating main parts of the configuration of a fully automatic washing machine 1 according to modification I. It is noted that illustration of the hanger bracket 60 and the connecter 70 are omitted in FIG. 5.

In the above embodiment, the door portion 90 is directly attached to the front ends of the left and right holding plates 80 via the metal mounting member 81. In contrast, in this modification I, the door portion 90 is fixed to the left and right holding plates 80 via a buffer member 110 formed of an elastic material such as rubber. More specifically, in the case that the buffer member 110 is sandwiched between the front surface of the metal mounting member 81 fixed to the holding plates 80 and the rear surface of the door portion 90, the metal mounting member 81 and the door portion 90 are fixed together via a stepped screw 120.

With such a configuration, vibrations of the holding plate 80 can be absorbed by the buffer member 110, so that vibrations are hardly to be transferred to the door portion 90, and the minute collisions between the door portion 90 and the peripheral edge of the entrance 11 of the outer casing 10 are less likely to occur.

Furthermore, in this modification, a buffer member 130 formed of an elastic member such as rubber is provided between the rear surface of the door portion 90 and the peripheral portion of the entrance 11 on the front surface of the outer casing 10.

With such a configuration, even if a slight collision occurs between the door portion 90 and the peripheral edge of the entrance 11 of the outer casing 10, the impact on the door portion 90 and the outer casing 10 is remitted by the buffer member 130, so that noises and damages are less likely to occur.

OTHER MODIFICATIONS

Figure 6:
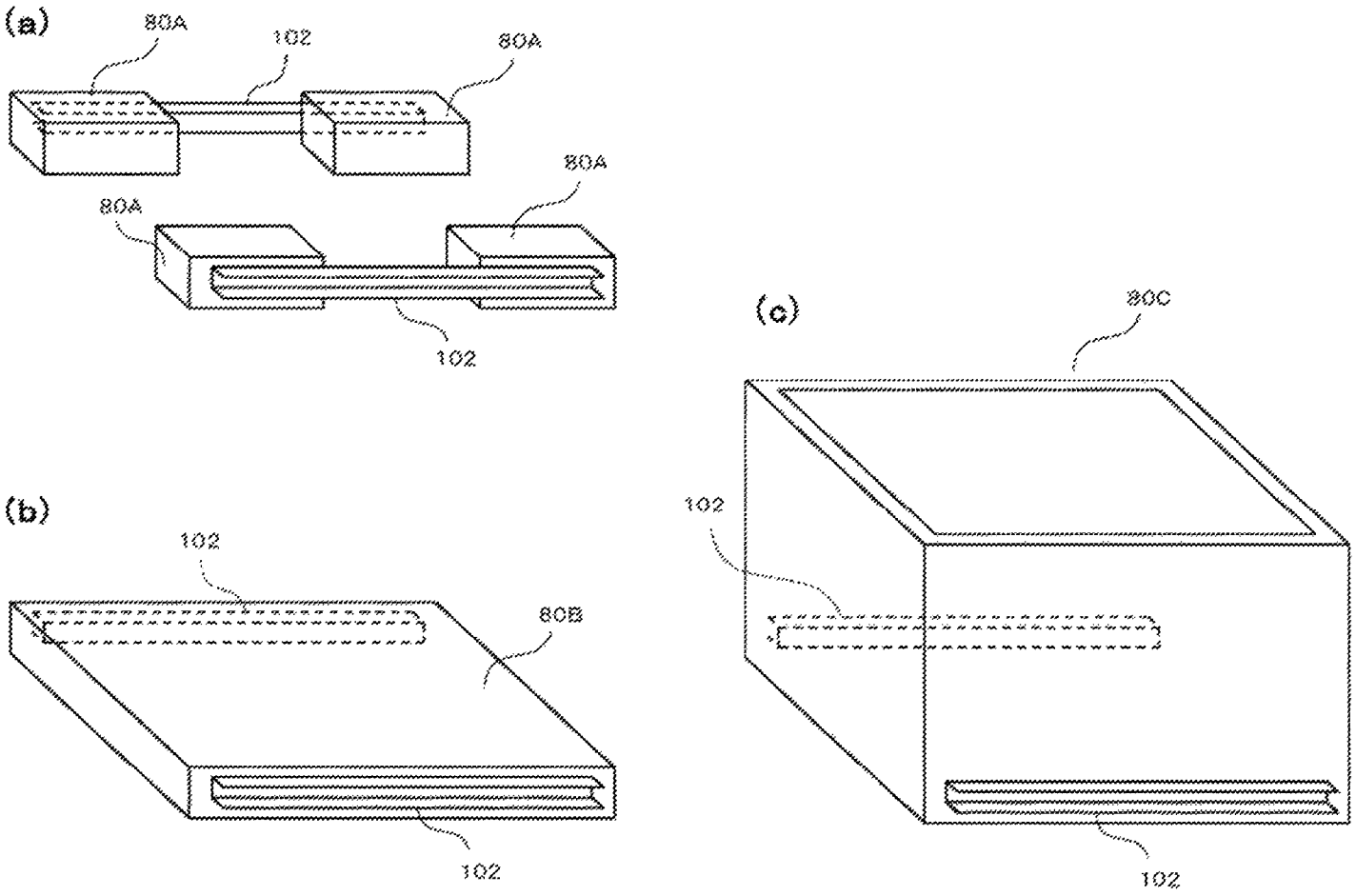
FIGS. 6(*a*) and 6(*b*) illustrate a configuration of a holding plate according to another modification, and FIG. 6(*c*) illustrates a configuration of a cabinet according to another modification.

In the above embodiment, the washing tub 20 is held by the left and right holding plates 80. However, a holding portion for holding the washing tub 20 is not limited to this configuration. For example, as shown in FIG. 6(*a*), a structure, in which four holding plates 80A are provided (i.e., a left front holding plate, a left rear holding plate, a right front holding plate and a right rear holding plate) and the movable guiding rail 102 on the left side is attached at the two holding plates 80A on the left side (i.e., the left front holding plate and the left rear holding plate), is adopted. Alternatively, as shown in FIG. 6(*b*), a structure, in which one holding plate 80B is provided and the left and right movable guiding rails 102 are attached at the left and right sides of the holding plate 80B respectively, is adopted. Further, as the holding portion, as shown in FIG. 6(*c*), a structure in which an open top cabinet 80C is provided and the movable rail 102 is attached to the lower portion of the left and right side surfaces of the cabinet 80C, can also be adopted.

Figure 7:
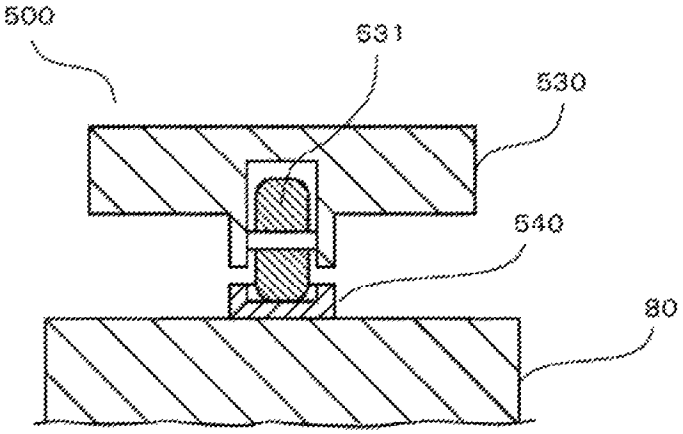
FIG. 7 illustrates a configuration of a vibration absorber according to another modification.

Further, in the above embodiment, the vibration isolating device 500 is composed of the slider 510 and the guiding rail 520. However, the present disclosure is not limited to this. As shown in FIG. 7, in the vibration isolating device 500, a moving block 530 having a roller 531 is fixed to the lower surface of the mounting base 400, and the moving block 530 moves on a groove-shaped guiding rail 540 in the front-rear direction. In this case, the frictional force between the roller 531 and the guiding rail 540 is smaller than the frictional force generated between the movable guiding rail 102 and the fixed guiding rail 101 as the movable guiding rail 102 moves in the front-rear direction with respect to the fixed guiding rail 101.

Furthermore, in the above embodiment, the sliding guiding rail 100 including the fixed guiding rail 101 and the movable guiding rail 102 is used to make the holding plate 80 for holding the washing tub 20 move in the front-rear direction. However, the present disclosure is not limited to this. For example, the sliding mechanism also can use the following structure: rollers are provided at the lower portions of the left and right inner side surfaces of the outer casing 10, and the rollers contact with the guiding rail provided on the bottom surfaces of the left and right holding plates 80 and rotate. As a result, the guiding rail is transported in the front-rear direction.

Furthermore, in the above embodiment, the hanger bracket 60 is constituted by the damper portion 200 and the spring portion 300. However, the hanger bracket 60 may be constituted only by the damper portion 200 or the spring portion 300.

Furthermore, in the above embodiment, the fully automatic washing machine 1 has been illustrated, but the present disclosure can also be applied to a fully automatic washing/drying machine having a drying function in addition to the washing function.

Further, various modifications can be made to the embodiments of the present disclosure as appropriate within the scope of the technical idea described in the claims.

What is claimed is:

1. A washing machine, comprising:

an outer casing, wherein an entrance is provided on a front surface of the outer casing;

a washing tub in which washings are washed and dewatered, wherein the washing tub enters into or exits from the outer casing through the entrance;

a holding portion disposed below the washing tub and configured to support the washing tub via a hanger bracket;

a door portion fixed to the holding portion in front of the washing tub, wherein the entrance is blocked by the door portion when the washing tub is accommodated in the outer casing;

a sliding mechanism provided between the holding portion and the outer casing and configured to linearly move the holding portion together with the washing tub and the door portion in a front-rear direction, and a connecter for connecting the hanger bracket with the holding portion, wherein the connecter comprises a vibration absorber configured to prevent vibrations of the washing tub in the front-rear direction from being transferred to the holding portion via the hanger bracket;

wherein the vibration absorber comprises a moving path and a movable member, wherein the moving path is provided on the holding portion, and the movable member is provided on the hanger bracket and configured to move on the moving path in the front-rear direction, wherein a frictional force generated when the movable member moves on the moving path is smaller than a frictional force generated when the holding portion is caused to move by the sliding mechanism.

2. The washing machine according to claim 1, wherein the movable member is guided by the moving path and does not move in a left-right direction.

3. The washing machine according to claim 2, wherein the door portion is fixed to the holding portion via a buffer member.

4. The washing machine according to claim 1, wherein the door portion is fixed to the holding portion via a buffer member.

* * * * *